United States Patent [19]

Peter et al.

[11] Patent Number: 4,787,422

[45] Date of Patent: Nov. 29, 1988

[54] WEAVING REED WITH PROFILED TEETH

[75] Inventors: Erich Peter, Lindau; Rudolf Riezler, Nonnenhorn, both of Fed. Rep. of Germany

[73] Assignee: Lindauer Dornier Gesellschaft mbH, Lindau, Fed. Rep. of Germany

[21] Appl. No.: 94,817

[22] Filed: Sep. 9, 1987

[30] Foreign Application Priority Data

Sep. 30, 1986 [DE] Fed. Rep. of Germany ..... 3633139
Dec. 13, 1986 [DE] Fed. Rep. of Germany ..... 3642712

[51] Int. Cl.[4] ..... D03D 47/28
[52] U.S. Cl. ..... 139/435; 139/192
[58] Field of Search ..... 139/435, 188 R, 192

[56] References Cited

U.S. PATENT DOCUMENTS 4,401,139 8/1983 Koriyama et al. ..... 139/435
4,458,732 7/1984 Yoshida et al. ..... 139/435
4,569,376 2/1986 Jolland et al. ..... 139/435

FOREIGN PATENT DOCUMENTS 51613 12/1984 Japan ..... 139/435

*Primary Examiner*—Henry S. Jaudon
*Attorney, Agent, or Firm*—W. G. Fasse; D. H. Kane, Jr.

[57] ABSTRACT

A profiled weaving reed, especially for shuttleless looms with pneumatic weft thread insertion, has profiled reed teeth which are so deformed along the path of weft thread insertion that a first deformation forms an edge slanted in the direction of weft thread insertion while a further deformation on the opposite side of the respective reed tooth is slanted in the opposite direction. The first deformations may, for example, have a bent edge. The first and further deformations of all individual reed teeth form, over the width of the reed a type of groove or throat in which the weft thread is guided. The deformations prevent or greatly reduce an air loss through the reed and improve the air flow transporting the weft thread.

9 Claims, 2 Drawing Sheets

WEAVING REED WITH PROFILED TEETH

FIELD OF THE INVENTION

The invention relates to a weaving reed with profiled teeth for weaving looms with pneumatic weft thread insertion.

DESCRIPTION OF THE PRIOR ART

A reed with profiled teeth is conventionally used in looms with pneumatic weft thread insertion, whereby the individual reed teeth together form a weft thread guide channel. The profile of known reed teeth includes two longitudinally spaced ramp type noses projecting from the straight edge of the respective reed tooth toward the beat-up edge of the fabric. The projecting noses form a channel between them and the channel has a depth reaching approximately to the straight line defined by the front edge of the reed tooth. The flanks of the channels are straight and normally extend in parallel to each other, whereby the flank spacing corresponds to the width of the guide channel for the weft thread.

In looms with a pneumatic weft thread insertion it is necessary that the reed teeth are spaced relatively closely to each other in order to keep any loss of air through the spacing between neighboring teeth as small as possible during the weft thread insertion so that there is sufficient air in the air flow for transporting and inserting the weft thread. For the same reason it is desirable that the width of the weft thread guide channel is not too large to avoid an air loss. However, a narrow weft thread guide channel has the disadvantage that at least certain types of weft threads are exposed to friction as they pass through the guide channel. For example, so-called burled yarns are exposed to such friction when the burled yarn is pulled through the guide channel. This friction can become large enough to interrupt the movement of the burled yarn through the guide channel, whereby the proper thread insertion may become questionable and under certain circumstances, the inserted weft thread may be damaged. Thus, it is known to alternate reed teeth with projecting noses with reed teeth having a smooth profile. Such a reed construction reduces the friction between the edges of the reed projections and the thread being inserted. However, such a structure is subject to considerable air loss due to the teeth without projections adjacent to the guide channel.

The projecting noses of the profiled reed teeth also cause difficulties yet in another respect because during the beat-up motion of the weaving reed the reed teeth projections move close to the expander for the finished fabric. In order to avoid contact between the reed and the expander, it would be possible to provide a safety spacing between the beat-up position of the reed and the expander. However, such a safety spacing would reduce the effectiveness of the expander because the expander effect should be applied as close to the beat-up edge of the fabric as possible. Due to this fact, reed constructions have been used in which the reed teeth do not have any projections in the zone of cooperation with the expander so that no guide channel for the weft thread is formed. However, in such a structure one must make do with a weft thread guiding that is less exact than when a weft guide channel is used.

OBJECTS OF THE INVENTION

In view of the foregoing it is the aim of the invention to achieve the following objects singly or in combination:

to assure in a shuttleless loom with a pneumatic weft thread insertion a good guiding of the weft thread without the disadvantages of an excessive air loss in the guide channel;

to construct a reed which is quite suitable for different kinds of weft threads so that even burled and rather coarse weft threads can be properly guided in a relatively large gap formed by the reed teeth without a conventional guide channel; and to avoid the above mentioned difficulties caused by an interference between the expander and the reed when the reed moves into its beat-up position.

SUMMARY OF THE INVENTION

A reed tooth according to the invention is equipped with but one guide channel forming projection. The projection in each tooth of a reed is provided with a recessed portion for guiding the weft thread. The recessed portion is deformed so that the respective deformation is slanting in the direction of weft thread insertion. In one embodiment all deformations are so located and reach into the gap between neighboring reed teeth that the air flow through the guide channel is improved and so that an air loss in the guide channel is prevented or at least substantially reduced. The deformation of each reed tooth edge as taught by the invention can be accomplished in different ways. For example, it is possible to bend over the edge of the reed tooth in the proper location to a sufficient width or extent in the weft thread insertion direction. For certain applications, depending, for example, on the type of weft thread to be used, it is sufficient to provide the teeth edge with a bevel slanting in the direction of weft thread insertion.

It has been found that the deformed portion of the teeth profile according to the invention has a guiding and stabilizing effect on the air stream due to the slanting or beveling. Especially the bent over edge of the tooth profile functions as a guide vane for the air stream, thereby improving the air flow for the weft thread insertion. Additionally, the bent over edge of each reed tooth reaches into the gap between neighboring reed teeth, thereby reducing the clearance between neighboring teeth in the guide channel. This feature in turn reduces air loss through the gaps between neighboring reed teeth. Yet another advantage of the invention is seen in that the weft thread no longer must pass along edges of the reed teeth profile, but rather passes along the slanting or bent-over surfaces which avoids any danger of damaging the weft thread. It has been found that the bent over or slanted edge does not need to extend in parallel to the weft thread insertion direction. Rather, it is sufficient to simply bend over the edge of the reed tooth to a small extent approximately so that the bent over portions form an acute angle with the insertion direction. This embodiment with a bent over edge is equally effective as the other embodiment in which the particular portion of the reed teeth is beveled.

In the embodiment with a bent-over tooth edge portion, all these portions are preferably arranged in the manner of fish-scales for performing two functions. One function is the formation of guide vanes or surfaces for the air flow. The other function is to provide remaining intermediate spaces in the gaps between neighboring reed teeth to cause an injector effect on the back side of the reed. This injector effect not only prevents air losses through the gaps between neighboring reed teeth, it actually pulls additional air into the inserting air stream, thereby even stabilizing the inserting air stream.

The effect of deforming the tooth edge as taught herein is so significant that it is no longer necessary to have two profiled nose projections for defining the weft thread insertion guide channel. In fact, it is now sufficient to provide but one nose projection on each tooth and to locate these nose projections of all teeth in a row below the path of the weft thread. The transition zone between the upwardly facing edge of the nose projection and the straight portion of the respective reed tooth is so deformed according to the invention that a type of recess or back taper is formed in the teeth profile. This recess also referred to as "hollow throat" extends in the weft thread insertion direction and over the width of the reed teeth. This recess or "hollow throat" functions as a guide channel for the weft thread so that reed teeth constructed according to the invention do not require any more an upper nose type projection for the formation of the guide channel.

The invention achieves substantial advantages with regard to two main aspects. The first aspect relates to the direct guiding of the weft thread to be inserted by the air stream. The other aspect relates to the beat-up of the inserted weft thread, whereby the thread is guided by the straight portion of the reed teeth located above the mentioned recess, all the way to the beat-up edge of the fabric. This function is achieved although profiled portions of the reed tooth, or rather reed teeth, that is the projecting nose portions, are removed out of the zone of the beat-up edge. Since the invention does not use an upper nose projection, it is possible to firmly beat-up the weft thread very close to the expander.

Due to the advantageous flow conditions created according to the invention for the weft thread insertion air flow, it is now possible to use a reed having a relatively large coarse raster. Heretofore, it was impossible to use such a reed in connection with looms having a pneumatic weft thread insertion. Additionally, the coarse reed has a lighter weight and that lightweight is further reduced due to the use of but one nose projection rather than two as in the prior art. A lighter reed additionally positively influences the energy consumption of the entire loom.

In connection with woven fabrics using certain kinds of weft threads, it may be necessary to pay special attention that the weft thread is properly guided in the guide channel without any fault, for example, that it always rests firmly against the upper nose edge. Such a special thread guiding can be achieved, for example in a known manner by a fine adjustment of the effective direction of auxiliary nozzles. However, such adjustment of auxiliary nozzles is cumbersome and causes difficulties where there are larger spacings between the auxiliary nozzles. However, the desired effect can also be achieved, as has been found according to the invention, and in a substantially simpler, less critical manner in that each reed tooth is provided with a further deformation in addition to the first mentioned deformation. According to the invention such further deformation is slanted in a direction opposite to the weft thread insertion direction. Further, the additional deformation is located in that zone of the reed tooth profile in which the weft thread is supposed to contact the reed tooth. Thus, the zone is preferably an area on the upper nose edge of the reed tooth profile near the bottom of the weft thread guide channel. This further deformation is preferably constructed as a further beveling and causes a downward flow component of the weft thread insertion air stream between the nose projections of the reed teeth so that the thread is held in contact with the upper edge of the nose projection. This embodiment of the reed teeth according to the invention with a second deformation involves a slight loss of air between neighboring reed teeth. However, that air loss is substantially less than the gain obtained by the first mentioned deformation. Therefore, the advantage of the proper guiding of the weft thread against the upper edge of the nose projection by the further deformation, fully outweighs any slight air loss.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
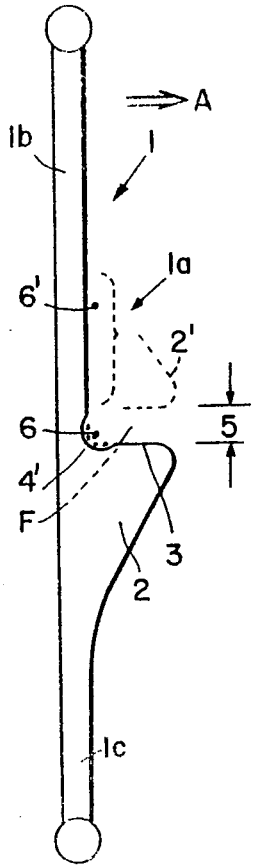
FIG. 1 shows a reed tooth profile as seen from the side in the direction of weft thread insertion.

Referring to FIG. 1, a reed tooth 1 also referred to as a reed lamella, has three straight sections 1*a*, 1*b*, and 1*c*, for example, and one nose 2 projecting in the beat-up direction indicated by the arrow A. A conventional reed tooth of this type would also include a second projecting nose 2' indicated by a dashed line. The invention avoids such second nose. The nose 2 has a substantially straight upwardly facing edge 3 and the shape of the nose as such is conventional. A guide channel F for the weft thread 6 is formed above the edge 3. Conventionally, the guide channel F would be confined between the two noses 2, 2' and would have a channel width 5.

Figure 2:
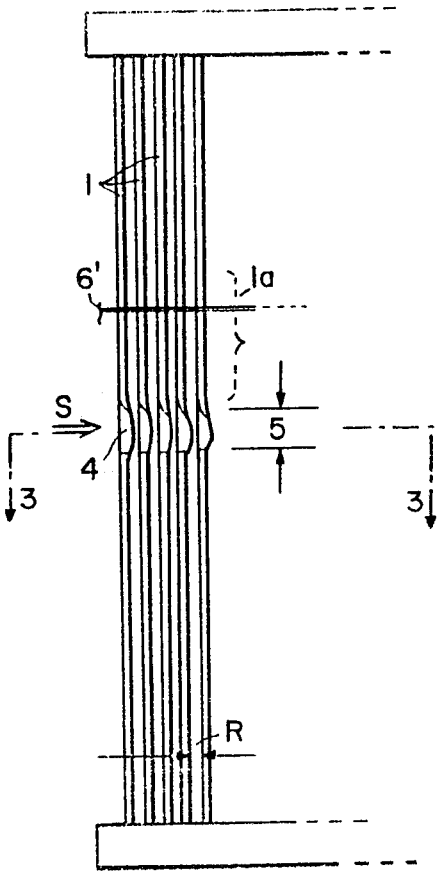
FIG. 2 shows a front view onto a portion of the reed in a direction as viewed opposite to the beat-up direction movement.

According to the invention a satisfactory guide channel F is formed by providing each reed tooth in the zone 4' where the tooth merges into the straight portion 1*a* with a first deformation 4. In one embodiment the first deformation 4 is a bent-over edge of the bottom of the guide channel as best seen in FIG. 2. The bent-over edge 4 is slanting in the direction S of weft thread insertion. The bent-over edge 4 forms a type of guide vane or surface for the air stream transporting the weft thread. The dots in FIG. 1 in the zone 4' are intended to show the original profile at the transition between the nose 2 and the straight section 1*a*.

Figure 4:
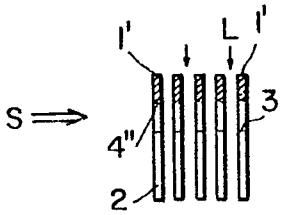
FIG. 4 is a sectional view similar to that of FIG. 3, but showing a modified embodiment of the invention.
Figure 3:
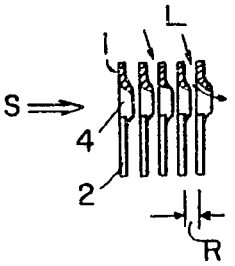
FIG. 3 is a sectional view through the reed along section line 3—3 in FIG. 2.

As seen in FIGS. 1 and 2 the bent-over deformed edge 4 form a recess in the transition zone 4'. The bent-over edge 4 and thus the recess are wider than the thickness of the individual reed teeth 1 in the direction S of a thread insertion. In the longitudinal direction each bent-over edge 4 has a length corresponding to the width 5 of a conventional thread guide channel F. Since according to the invention the bent-over edges 4 make the reed teeth wider in the thread insertion direction S, the gap R between neighboring reed teeth 1 is reduced in the area of the guide channel F, please see FIG. 2. The bent-over portions or deformations slanting in the insertion direction S do not need to extend in parallel to the direction S. Rather, these deformations form advantageously an acute angle with the insertion direction S. Additionally, the bent-over edges 4 are arranged in the manner of fish-scales so that they can perform two functions, namely provide guide vanes or surfaces for the weft thread inserting air stream and for causing an injector effect behind the reed to cause a suction flow L as best seen in FIGS. 3 and 4. This suction flow L is caused to enter into the guide channel by the injector effect and prevents an air loss through the gaps R. Additionally, the suction flow L enhances or supports the transport of the weft thread.

The effects achieved by the features of the invention are so substantial that it is no longer necessary to use reed teeth with two projecting noses. Rather, a reed tooth profile with a single projecting nose 2 below the path of the weft thread 6 is sufficient. It has been found that the bent-over portion and the resulting recess in the transition zone 4' provides a most efficient weft thread guide channel since the mentioned recess or "hollow throat" causes the above described air flow effects.

FIG. 1 shows the position of the weft thread 6 in the "hollow throat" at the beginning of a thread insertion. During the beat-up motion of the reed in the direction A the weft thread 6 moves from the lower position into the upper position shown at 6'. This feature enables a fault-free and firm beat-up of the weft thread. At the actual beat-up point of time, the weft thread takes up approximately the position 6'. FIG. 2 only shows the weft thread in the position 6'.

FIG. 4 shows a modification of the invention in which the reed teeth 1' are provided with a first deformation 4" in the form of a bevel slanting in the thread insertion direction S. The upper portion of the reed teeth 1' in FIG. 4 are shown in section and the projecting nose portions 2 show their upper edges 3. It has been found that the first deformations or slanting bevels 4" have the same effect as the bent-over edges shown at 4 in FIGS. 2 and 3. These bevels even achieve a suction effect as indicated by the arrows L in FIG. 4. The type and the manner of producing the bevel are not important for the invention as long as the slanting bevels 4" enclose an acute angle with the insertion direction S.

Figure 5:
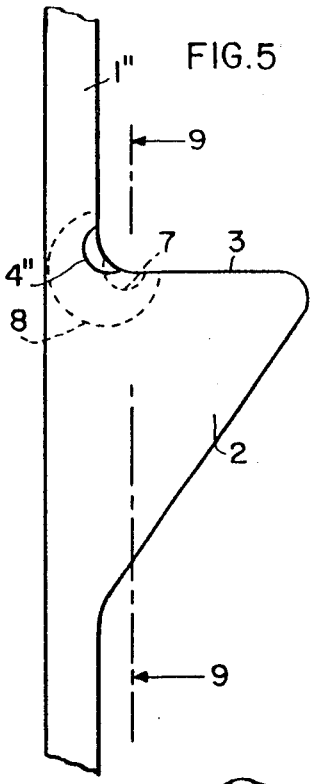
FIG. 5 is a profile view of a reed tooth according to the invention having two different kinds of deformations.
Figure 6:
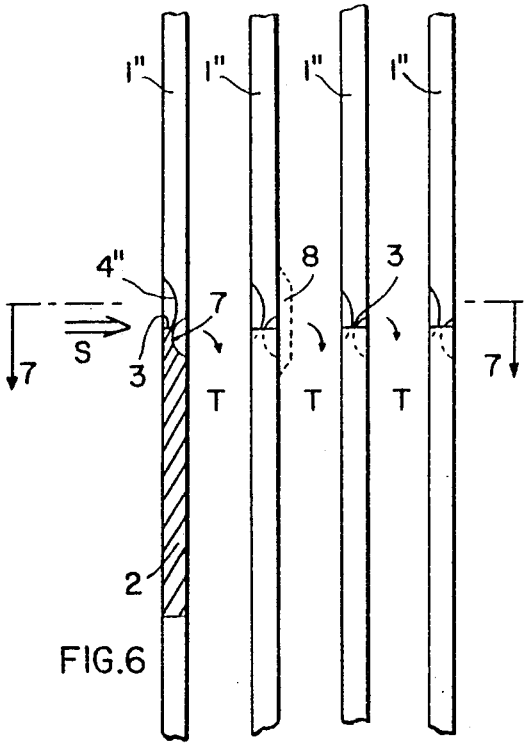
FIG. 6 is a view similar to that of FIG. 2, but showing the reed with reed teeth according to FIG. 5.
Figure 8:
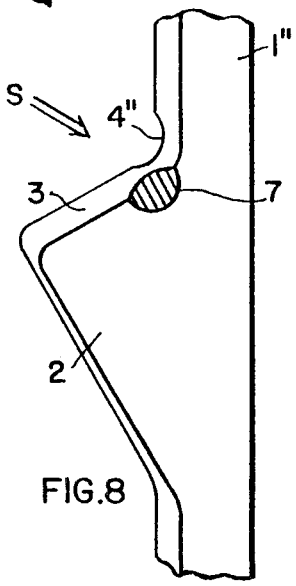
FIG. 8 is a perspective view of a reed tooth according to FIG. 5 in a substantially enlarged presentation.
Figure 7:
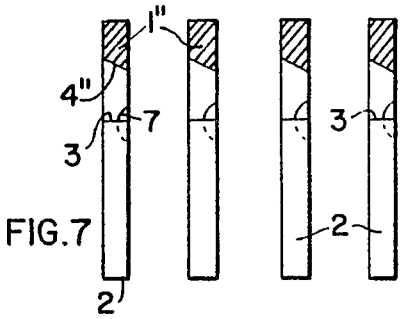
FIG. 7 is a sectional view along section line 7—7 in FIG. 6.

The enlarged illustrations of FIGS. 5, 6, and 7 show another embodiment or modification of the invention in which in addition to the above described first deformations 4, 4" there is a further deformation 7 in the zone where the upper edge 3 of the projection 2 merges into the straight portion of the respective reed tooth 1". As best seen in these Figs. one first deformation 4" is provided on one side of the reed tooth and the further deformation 7 is provided on the opposite side of the reed tooth, whereby the further deformation 7 slants in a direction opposite to the thread insertion direction S. The further deformation 7 is preferably, but not necessarily, slightly displaced relative to the deformation 4" along the upper edge 3 of the nose 2 as best seen in FIG. 8. The deformation 7 is also formed as a beveled recess. In FIG. 5 the displacement of the deformation 7 relative to the deformation 4" is also indicated by the curved dashed line since the deformation 7 is not directly visible in FIG. 5.

As shown in FIG. 6, each reed tooth 1" is provided with two deformations 4" and 7. One reed tooth 1 is shown partially in section approximately along the section line 9—9 in FIG. 5. However, in FIG. 6, only one individual reed teeth 1" is provided with a reinforcement plate 8 which is shown by dashed lines in FIGS. 5 and 6 and in full lines in FIG. 9.

Due to the slanting of the further deformation 7 against the direction of thread insertion S, a partial air flow T shown in FIG. 6 is developed between the nose-type projections 2 of neighboring reed teeth 1". This partial air stream T is directed downwardly, thus enabling the thread 6, not shown in FIG. 6, to be guided downwardly against the upper edge 3 of the nose projections 2. Thus, the further deformation 7 with its partial air stream T has the important advantage that a fine adjustment of auxiliary nozzles is avoided. As a result, the overall structure of the reed is simpler and hence less critical. FIG. 7 is a view similar to that of FIG. 3 along the section line 7—7 in FIG. 6.

Figure 9:
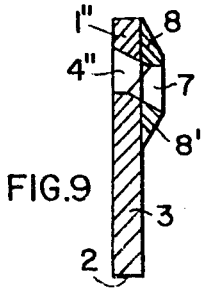
FIG. 9 shows a sectional view along section line 9—9 in FIG. 5 for illustrating the two deformations as well as a reinforcing plate attached to the reed tooth next to the deformations.

Referring specifically to FIG. 8, the enlarged view shows the direction of the thread insertion and thus the direction of the air stream by the arrow S passing from left to right over the upper edge 3 of the nose projection 2. The position of the further deformation 7 on the profile of the reed tooth 1" must be so selected that it defines the location at which the weft thread is supposed to contact the reed tooth 1". Thus, the further deformation 7 may be located as shown closer to the upper edge 3 of the nose projection 2 or it may be located further up on the straight portion of the reed tooth 1".

Where the individual reed teeth are very thin in the direction S it is recommended to provide reinforcing plates 8 as shown in dashed lines in FIG. 5 and in the sectional view of FIG. 9 in full lines. For simplicity's sake only one reinforcing plate 8 is shown in dashed lines also in FIG. 6. These reinforcing plates 8 may, for example, be soldered or brazed to the reed teeth 1". It is not important on which side of the reed tooth the reinforcing plates are attached. However, these plates should be located where the "hollow throat" is located in the transition between the upper edge 3 and the straight portion of the reed tooth. The first and further deformations 4" and 7 can be somewhat more pronounced where such a reinforcing plate is used as may be seen in FIG. 9 where the respective deformations reach into the reinforcing plate 8. In order to avoid damage to the weft thread, it is preferable that the outer edge of the reinforcing plate 8 is also beveled as shown at 8'.

The pneumatic means for the weft thread insertion are not shown and may be of any conventional type. These inserting means are not part of the invention. For example, a row of individual needle nozzles may be arranged along the reed in front of the "hollow throat"

or recess. These needle nozzles may be supplied with air in a sequential manner.

Although the invention has been described with reference to specific example embodiments, it will be appreciated that it is intended to cover all modifications and equivalents within the scope of the appended claims.

What we claim is:

1. A weaving reed for weaving looms with pneumatic weft thread insertion, comprising profiled reed teeth each with a nose projection for forming a weft thread guide channel, each nose projection having a recessed portion (4') for guiding a weft thread through said guide channel, said recessed portion having a first deformation including a first bevelled edge (4'') the bevel of which is slanting in the direction (S) of weft thread insertion for an improved guiding of an air flow carrying a weft thread through said guide channel and for preventing or at least reducing an air loss through gaps between neighboring reed teeth, each of said reed teeth having a further deformation (7) located on its profiled reed tooth substantially in a weft thread contact zone, said further deformation (7) slanting in a direction opposite to the weft thread insertion direction, said further deformations causing a partial, downwardly directed air stream (T) for guiding said weft thread along said nose projections.

2. The weaving reed of claim 1, wherein said further deformation (7) is displaced relative to said first deformation.

3. The weaving reed of claim 1, wherein said first deformations partially cover a gap (R) between neighboring reed teeth.

4. The weaving reed of claim 1, wherein said first deformations are bent edges of said reed teeth.

5. The weaving reed of claim 1, wherein said nose projection has an upwardly facing edge extending at an angle relative to the length of the respective reed tooth, said first deformation being located in a transition zone between said upwardly facing edge and a straight portion of the respective reed tooth, said first deformation forming a recess (4') in said transition zone, said recess having a wall slanting in said weft thread insertion direction.

6. The weaving reed of claim 5, wherein said recess (4') has a width, in the longitudinal reed tooth direction, corresponding substantially to a width of said weft thread guide channel.

7. The weaving reed of claim 5, wherein said first deformations project laterally out of a plane defined by the respective reed tooth so that projections of neighboring reed teeth are arranged in a fish-scale type manner.

8. The weaving reed of claim 1, further comprising a reinforcing plate secured to the respective reed tooth in a zone where said first and second deformations are located.

9. The weaving reed of claim 8, wherein said reinforcing plate has a bevelled edge facing outwardly from the respective reed tooth.

* * * * *